US006956319B2

(12) United States Patent
Hanashi et al.

(10) Patent No.: US 6,956,319 B2
(45) Date of Patent: Oct. 18, 2005

(54) STRUCTURE OF SPARK PLUG DESIGNED TO PROVIDE HIGHER WEAR RESISTANCE TO CENTER ELECTRODE AND PRODUCTION METHOD THEREOF

(75) Inventors: Ken Hanashi, Aichi-pref. (JP); Yasutake Ishino, Aichi-pref. (JP)

(73) Assignee: Denso Corporation (JP)

( * ) Notice: Subject to any disclaimer, the term of this patent is extended or adjusted under 35 U.S.C. 154(b) by 258 days.

(21) Appl. No.: 10/073,268

(22) Filed: Feb. 13, 2002

(65) Prior Publication Data

US 2002/0109447 A1 Aug. 15, 2002

(30) Foreign Application Priority Data

Feb. 13, 2001 (JP) ..... 2001-035929
Nov. 19, 2001 (JP) ..... 2001-353602

(51) Int. Cl.[7] ..... H01T 13/20
(52) U.S. Cl. ..... 313/123; 313/141; 123/169 P
(58) Field of Search ..... 313/141–143, 313/123, 118, 127; 127/169 R, 169 E, 169 P

(56) References Cited

U.S. PATENT DOCUMENTS 5,448,130 A * 9/1995 Matsutani et al. ..... 313/141
5,793,151 A * 8/1998 Kagawa et al. ..... 313/141
5,877,584 A * 3/1999 Kato et al. ..... 313/143
5,929,556 A * 7/1999 Matsubara et al. ..... 313/141
6,078,129 A * 6/2000 Gotou et al. ..... 313/141
6,229,253 B1 * 5/2001 Iwata et al. ..... 313/141
6,335,587 B1 * 1/2002 Matsubara ..... 313/141
6,552,476 B1 * 4/2003 Hanashi et al. ..... 313/141
6,597,089 B2 * 7/2003 Matsutani ..... 313/141
6,611,084 B2 * 8/2003 Teramura et al. ..... 313/141
6,617,706 B2 * 9/2003 Matsubara et al. ..... 313/141
6,724,133 B2 * 4/2004 Miyashita et al. ..... 313/143

FOREIGN PATENT DOCUMENTS

| | | |
|---|---|---|
| EP | 0964490 A2 | 12/1999 |
| EP | 0989645 A2 | 3/2000 |
| EP | 1 001 502 A2 | 5/2000 |
| EP | 1006631 A2 | 6/2000 |
| GB | 2 354 550 A | 3/2001 |
| JP | 6-176849 | 6/1994 |
| JP | 6196250 | 7/1994 |
| JP | 7-272826 | 10/1995 |
| JP | 8222351 | 8/1996 |
| JP | 2000-68032 | 3/2000 |
| JP | 2000-164319 | 6/2000 |
| JP | 2001-160475 | 6/2001 |

* cited by examiner

*Primary Examiner*—Joseph Williams
*Assistant Examiner*—Peter Macchiarolo
(74) *Attorney, Agent, or Firm*—Nixon & Vanderhye PC

(57) ABSTRACT

A spark plug structure produces sparks between a second ground electrode and a center electrode when a porcelain insulator is stained with carbon. A wear resisting member is installed on a side wall of the center electrode for minimizing the wear of the side wall caused by the sparks to increase the useful life of the spark plug. A production method is also provided.

12 Claims, 8 Drawing Sheets

STRUCTURE OF SPARK PLUG DESIGNED TO PROVIDE HIGHER WEAR RESISTANCE TO CENTER ELECTRODE AND PRODUCTION METHOD THEREOF

BACKGROUND OF THE INVENTION

1. Technical Field of the Invention

The present invention relates generally to a spark plug in which sparks are produced between a second ground electrode and a center electrode when a porcelain insulator is stained with carbon, and more particularly to an improved structure of such a type of spark plug designed to provide higher wear resistance to a center electrode for increasing the useful life of the spark plug and a production method thereof.

2. Background Art

European Patent Application EP 1 006 631 A2 discloses a conventional spark plug of a type in which production of electric sparks is initiated between a second ground electrode and a center electrode when a porcelain insulator is stained with carbon. FIG. 10 shows a typical structure of such a type of spark plug.

The spark plug includes a porcelain insulator 2 installed within a metal shell (not shown). Within the porcelain insulator 2, a center electrode 3 is disposed which has a tip 3*a* projecting from a tip 2*a* of the porcelain insulator 2. A noble metal chip 3*d* is welded to the tip 3*a* of the center electrode 3.

The spark plug also includes a first ground electrode 4 and a pair of second ground electrodes 5 (only one is shown for the brevity of illustration) which are installed on an end of the metal shell. The first ground electrode 4 is opposed at an end thereof to the noble metal chip 3*d* of the center electrode 3 to define a spark gap. The second ground electrode 5 has an end facing an end portion of a side surface of the center electrode 3 exposed outside the tip 2*a* of the porcelain insulator 2.

In operation, electric sparks are generated sequentially between the first ground electrode 4 and the center electrode 3 to ignite a gaseous fuel such as an air-fuel mixture injected into an internal combustion engine. When the fuel is burned, it will cause carbon to stick to the surface of the tip 2*a* of the porcelain insulator 2, thereby resulting in a decreased degree of electric insulation of the porcelain insulator 2. This causes sparks to be initiated between the second ground electrode 5 and the center electrode 3, thereby burning away the carbon adhered to the porcelain insulator 2. When the surface of the porcelain insulator 2 is cleaned of the carbon, it will cause sparks to be generated again between the first ground electrode 4 and the center electrode 3.

In order to improve the effects of burning the carbon away from the porcelain insulator 2, a shoulder 3*b* is formed on the center electrode 3 which tapers off to the tip 3*a*. A boundary 3*c* between a major portion of the center electrode 3 and the shoulder 3*b* is located inside the porcelain insulator 2.

The boundary 3*c* forms a corner on which an electric field is concentrated. Sparks, thus, fly, as indicated by an arrow in the drawing, over the tip 2*a* of the porcelain insulator 2 between the boundary 3*c* and the end of the second ground electrode 5, which serves to burn the carbon away from the porcelain insulator 2 effectively.

Researches carried out by the inventors of this application, however, showed that even though the carbon does not stick to the surface of the porcelain insulator 2, sparks may be produced between the second ground electrode 5 and the center electrode 3 depending upon specifications and/or operating conditions of the engine.

The production of sparks between the second ground electrode 5 and the center electrode 3 when there is no carbon sticking to the porcelain insulator 2 will cause a portion, as indicated by S in the drawing, of the side wall of the center electrode 3 to be worn or scooped away, thus resulting in scattering of metallic components of the center electrode 3 onto the surface of the porcelain insulator 2. When the metallic components are deposited on the porcelain insulator 2, it facilitates ease of production of sparks between the second ground electrode 5 and the center electrode 3, thus increasing wear of the side wall of the center electrode 3 undesirably.

SUMMARY OF THE INVENTION

It is therefore a principal object of the invention to avoid the disadvantages of the prior art.

It is another object of the invention to provide an improved structure of a spark plug of a type as described above which is designed to provide a higher wear resistance to a center electrode for increasing the useful life of the spark plug and a fabrication method thereof.

According to one aspect of the invention, there is provided an improved structure of a spark plug which may be employed in automotive engines and is designed to have a higher wear resistance to electrical sparks. The spark plug comprises: (a) a metal housing; (b) a porcelain insulator installed in the metal housing; (c) a center electrode retained within the porcelain insulator, the center electrode having a length and a tip portion projecting from a tip of the porcelain insulator; (d) a shoulder formed on a side wall of the center electrode to define a large-diameter portion and a small-diameter portion of the center electrode, the shoulder tapering off to the tip portion of the center electrode and having a boundary leading to the large-diameter portion located inside the porcelain insulator; (e) a first ground electrode installed on the metal housing which has an end portion opposed to the tip portion of the center electrode to define a first spark gap therebetween; (f) a second ground electrode installed on the metal housing which has an end arranged outside the tip of the porcelain insulator and opposed over the tip of the porcelain insulator to a portion of the side wall of the center electrode to define a second spark gap in which sparks are to be generated to burn away carbon adhered to a surface of the tip of the porcelain insulator, resulting in a decrease in insulation resistance offered by the porcelain insulator; and (g) a wear resisting member provided on the portion of the side wall of the center electrode for offering resistance to wear caused by the sparks generated in the second spark gap.

In the preferred mode of the invention, if an interval between an inner wall of the porcelain insulator and the side wall of the center electrode is defined as d, and a circle is defined which has a center on an inside corner of the tip of the porcelain insulator facing the center electrode and a radius R defined on a plane including a longitudinal center line of the spark plug, the radius R is preferably the interval d plus 0.1 mm and the wear resisting member is preferably lean at least inside the circle.

The wear resisting member has a width which is opposed to the center electrode and greater than or equal to 0.5 mm.

The wear resisting member is provided over an entire circumference of the side wall of the center electrode.

The resisting member may have a surface substantially lying flush with a surface of the side wall of the center electrode.

The wear resisting member is made of a metallic material which is higher in melting point than an Ni alloy. For example, the metallic material may be a Pt alloy or an Ir alloy.

According to the second aspect of the invention, there is provided a method of producing a spark plug including: (a) a metal housing; (b) a porcelain insulator installed in the metal housing; (c) a center electrode which is retained within the porcelain insulator and has a tip portion projecting from a tip of the porcelain insulator; (d) a first ground electrode installed on the metal housing which has an end portion opposed to the tip portion of the center electrode; and (e) a second ground electrode installed on the metal housing which has an end arranged outside the tip of the porcelain insulator and opposed over the tip of the porcelain insulator to a portion of a side wall of the center electrode. The method comprises the steps of: (a) preparing a center electrode material for making the center electrode; (b) machining the center electrode material to form a large-diameter portion, a small-diameter portion closer than the large-diameter portion to a tip of the center electrode material, and a shoulder between the large-diameter and the small-diameter portions; and (c) welding a wear resisting member to the shoulder of the center electrode material:

In the preferred mode of the invention, the method further comprises the step of machining the center electrode material and the wear resisting member welded to the shoulder of the center electrode material to establish a desired shape of the center electrode.

The method further comprises the step of welding a noble metal chip to a tip of the center electrode.

According to the third aspect of the invention, there is provided a method of producing a spark plug including: (a) a metal housing; (b) a porcelain insulator installed in the metal housing; (c) a center electrode which is retained within the porcelain insulator and has a tip portion projecting from a tip of the porcelain insulator; (d) a first ground electrode installed on the metal housing which has an end portion opposed to the tip portion of the center electrode; and (e) a second ground electrode installed on the metal housing which has an end arranged outside the tip of the porcelain insulator and opposed over the tip of the porcelain insulator to a portion of a side wall of the center electrode. The method comprises the steps of: (a) preparing a ring-shaped wear resisting member working to provide resistance to spark-caused wear; (b) preparing a center electrode material for making the center electrode; (c) machining the center electrode material to form a large-diameter portion, a small-diameter portion closer than the large-diameter portion to a tip of the center electrode material, and a shoulder between the large-diameter and the small-diameter portions; and (d) welding the ring-shaped wear resisting member to the shoulder of the center electrode material:

In the preferred mode of the invention, the method further comprises the step of machining the center electrode material and the ring-shaped wear resisting member welded to the shoulder of the center electrode material to establish a desired shape of the center electrode.

The method further comprises the step of welding a noble metal chip to a tip of the center electrode.

BRIEF DESPCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 4(*b*) is a top view of FIG. 4(*a*);

Figure 5A:
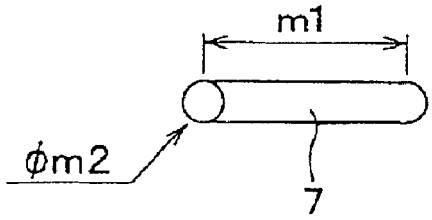
Figure 5B:
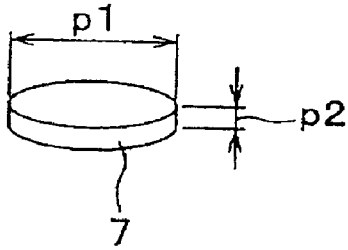
Figure 5C:
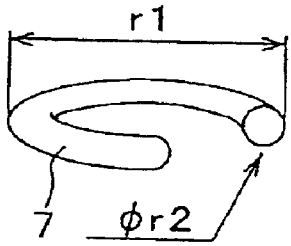
Figure 6A:
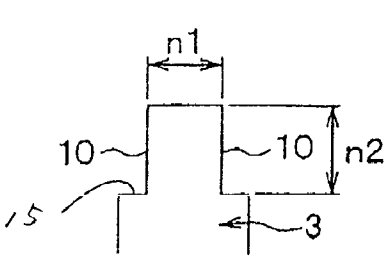
Figure 6C:
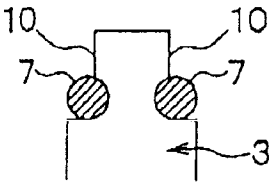
Figure 6D:
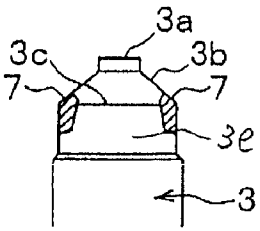
Figure 6E:
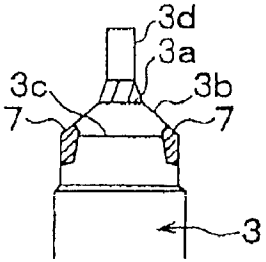
Figure 6B:
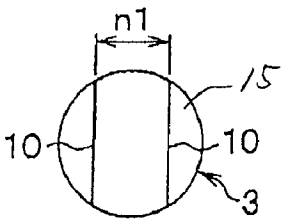
Figure 7A:
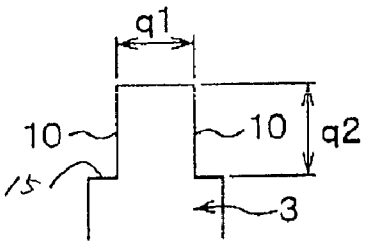
Figure 7C:
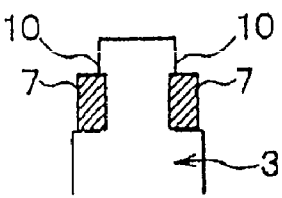
Figure 7D:
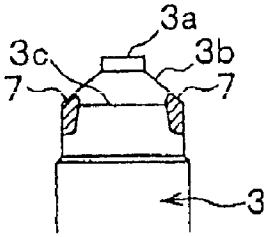
Figure 7E:
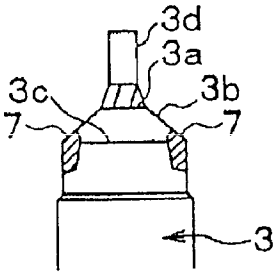
Figure 7B:
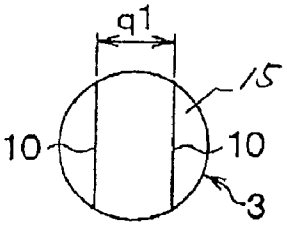
Figure 8A:
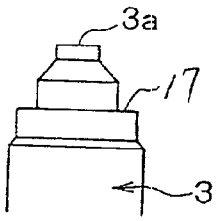
Figure 8C:
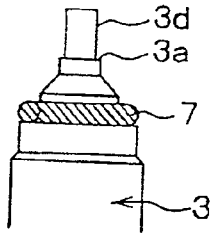
Figure 8D:
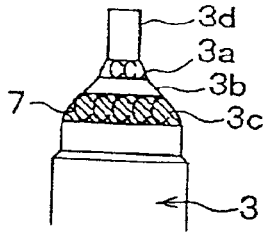
Figure 8B:
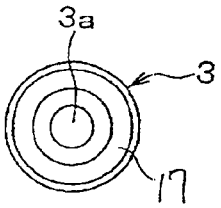
Figure 9A:
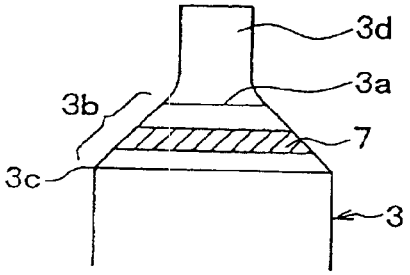
Figure 9B:
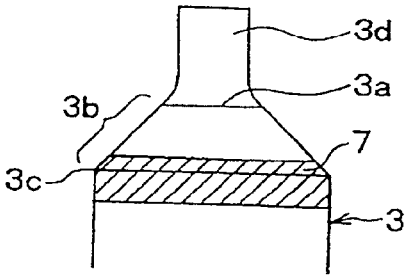
Figure 10:
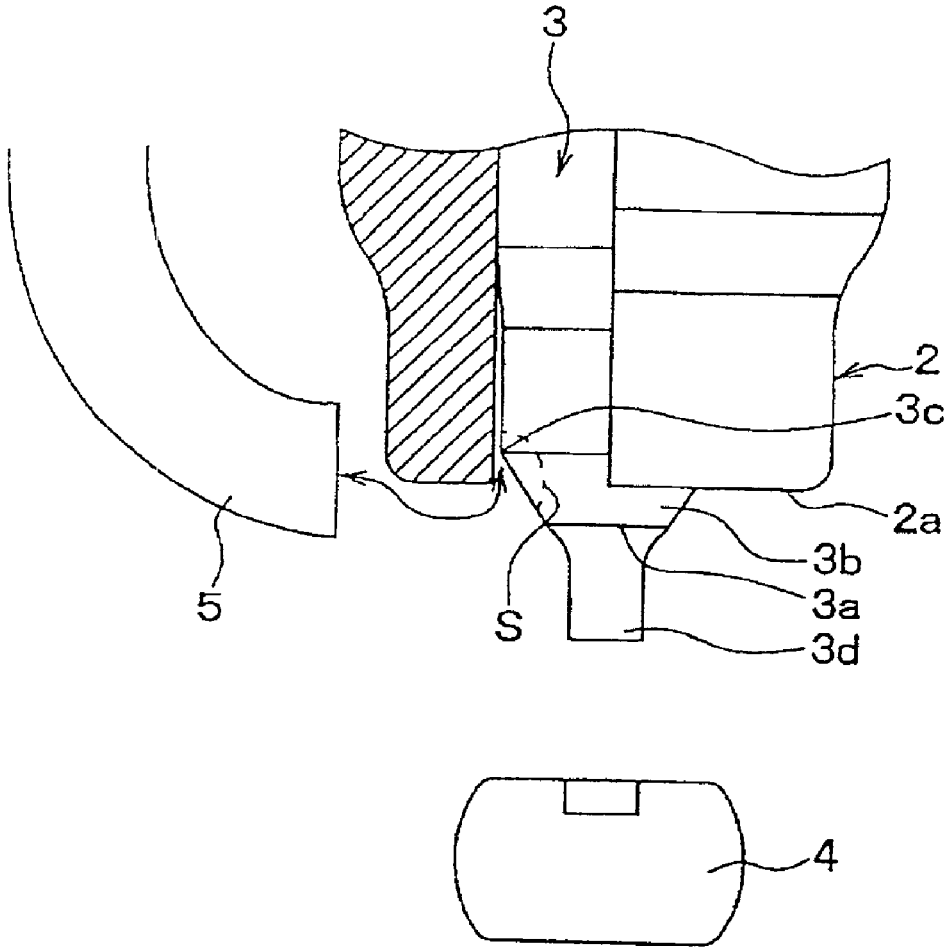
FIG. 10 PRIOR ART

FIGS. 5(*a*), 5(*b*), and 5(*c*) are perspective views which show materials which may be used in forming a wear resisting member;

FIGS. 6(*a*), 6(*c*), 6(*d*), and 6(*e*) are side views which show a sequence of fabrication processes of a wear resisting member using the material of FIG. 5(*a*);

FIG. 6(*b*) is a top view of FIG. 6(*a*);

FIGS. 7(*a*), 7(*c*), 7(*d*), and 7(*e*) are side views which show a sequence of fabrication processes of a wear resisting member using the material of FIG. 5(*b*);

FIG. 7(*b*) is a top view of FIG. 7(*a*);

FIGS. 8(*a*), 8(*c*), and 8(*d*) are side views which show a sequence of fabrication processes of a wear resisting member using the material of FIG. 5(*c*);

FIG. 8(*b*) is a top view of FIG. 8(*a*);

FIGS. 9(*a*) and 9(*b*) are side views which shows modifications of a wear resisting member; and FIG. 10 is a partially sectional view which shows a conventional spark plug in which a second ground electrode is opposed to a center electrode for producing sparks useful in burning carbon away from a porcelain insulator.

DESCRIPTION OF THE PREFERRED EMBODIMENTS

Figure 1:
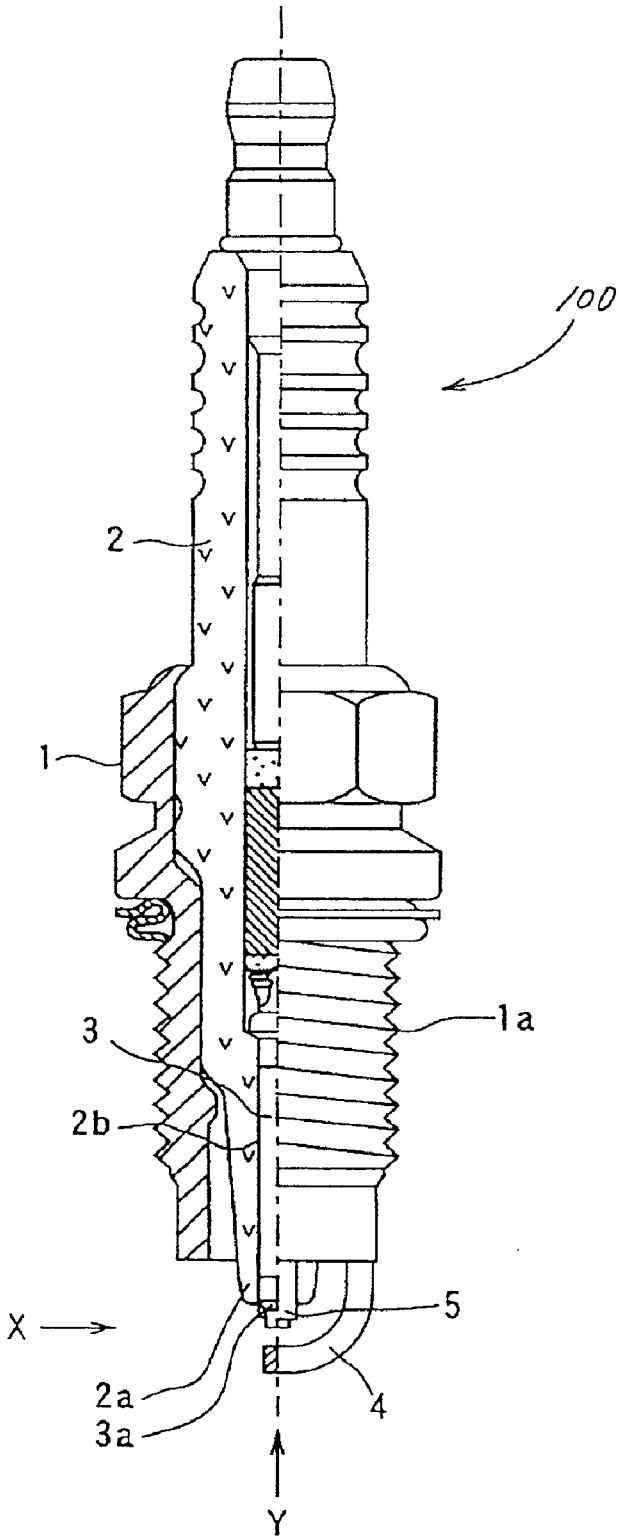
FIG. 1 is a partially sectional view which shows a spark plug according to the invention.
Figure 2:
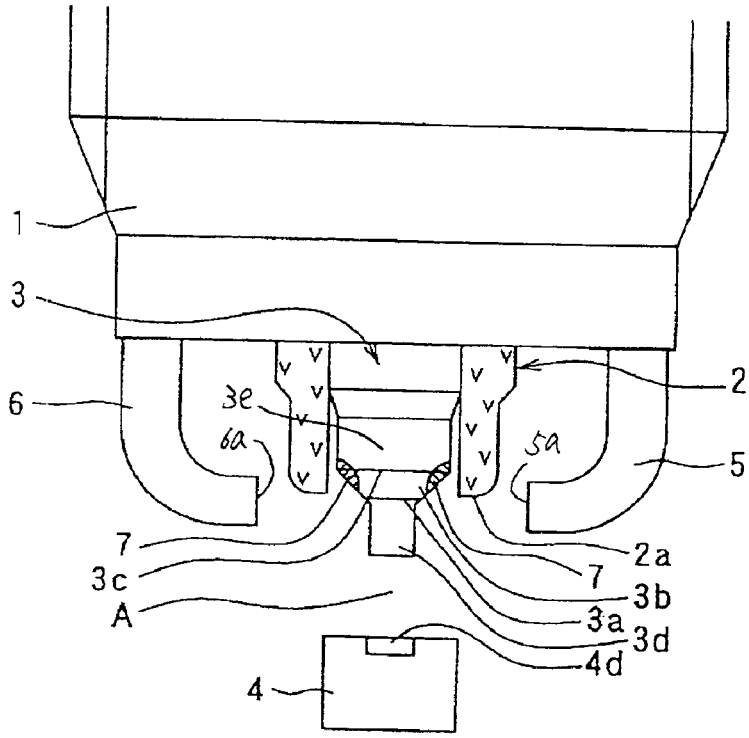
FIG. 2 is a partially enlarged view which shows a structure of a tip of the spark plug of FIG. 1.
Figure 3:
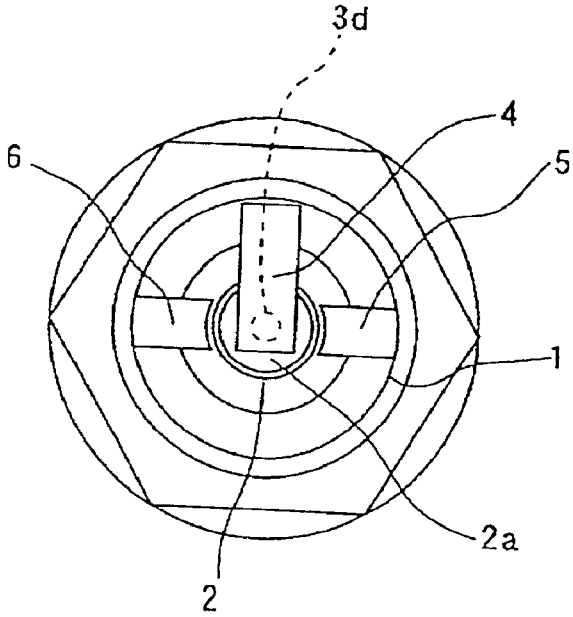
FIG. 3 is a top view of FIG. 2.

Referring to the drawings, wherein like reference numbers refer to like parts in several views, particularly to FIGS. 1 to 3, there is shown a spark plug 100 which may be used in internal combustion engines for automotive vehicles.

The spark plug 100 includes a cylindrical metal housing or shell 1, a porcelain insulator 2, a center electrode 3, a first ground electrode 4, and a pair of second ground electrodes 5 and 6 serving as auxiliary electrodes.

The metal shell 1 is made of a metallic cylinder and has cut therein a thread la for mounting the spark plug 100 in an engine block (not shown). The porcelain insulator 2 made of an alumina ceramic ($Al_2O_3$) is retained within the metal shell 1 and has a tip 2*a* exposed out of the metal shell 1.

The center electrode 3 is retained in a central chamber 2*b* of the porcelain insulator 2 and insulated electrically from the metal shell 1. The center electrode 3 has a tip 3*a* projecting from the tip 2*a* of the porcelain insulator 2. The center electrode 3 is formed by a cylindrical member which is made up of a core portion made of a metallic material such as Cu having a higher thermal conductivity and an external portion made of a metallic material such as an Ni-based alloy having higher thermal and corrosion resistances.

The center electrode 3, as clearly shown in FIG. 3, has a shoulder 3*b* tapering off to the tip 3*a* thereof The boundary 3*c* (will also be referred to as a base of the shoulder 3*b* below) between the shoulder 3*a* and a large-diameter portion 3*e* of the center electrode 3 is located inside the porcelain insulator 2. To an end surface of the tip 3*a* of the center electrode 3 (i.e., the top of the shoulder 3*b*), a noble metal chip 3*d* made of a Pt alloy or an Ir alloy is welded.

The first ground electrode 4 and the second ground electrodes 5 and 6 are, as clearly shown in FIGS. 2 and 3, welded to an end of the metal shell 1 and made of Ni-alloy or Fe-alloy poles. In FIG. 2, the porcelain insulator 2 is represented by a sectional view, and a base portion of the first ground electrode 4 connected to the end of the metal shell 1 is omitted for the sake of ease of visibility of the center electrode 3.

The first ground electrode 4 is, as can be seen from FIG. 1, bent inwardly and extends over the noble metal chip 3*d* installed on the tip 3*a* of the center electrode 3 to define a spark gap A, as shown in FIG. 2, between a side surface of the end of the first ground electrode 4 and the end of the noble metal chip 3*d*. In the side surface of the first ground electrode 4 opposed to the noble metal chip 3*d*, a noble metal chip 4*d* made of a Pt alloy or an Ir alloy is, as clearly shown in FIG. 2, embedded by welding The second ground electrodes 5 and 6 are opposed diametrically to each other and bent to have end surfaces 5*a* and 6*a* facing the shoulder 3*b* of the center electrode 3 beyond the tip 2*a* of the porcelain insulator 2 to define second spark gaps in which sparks are to be produced, as already described in the introductory part of this application, between the end surfaces 5*a* and 6*a* and the base 3*c* of the shoulder 3*b* beyond the tip 2*a* of the porcelain insulator 2 when the tip 2*a* of the porcelain insulator 2 is stained with carbon. The end surfaces 5*a* and 6*a* of the second ground electrodes 5 and 6 are located outside the tip 2*a* of the porcelain insulator 2. Only one of the second ground electrodes 5 and 6 may alternatively be installed on the metal shell 1.

In operation, a sequence of sparks are produced within the spark gap A or between the noble metal chips 3*d* and 4*d* of the center electrode 3 and the first ground electrode 4 to ignite and burn a gaseous fuel injected into the engine. The burning of the fuel will cause carbon to stick to the surface of the tip 2*a* of the porcelain insulator 2, thereby resulting in initiation of sparks between the second ground electrodes 5 and 6 and the center electrode 3 for the reasons as described in the introductory part of this application. The sparks are produced between each of the second ground electrodes 5 and 6 and an area of the side surface of the center electrode 3 which includes the base 3*c* of the shoulder 3 and faces the tip 2*a* of the porcelain insulator 2 and fly along the surface of the tip 2*a* of the porcelain insulator 2, thereby burning the carbon away from the surface of the porcelain insulator 2. When the carbon is burned out, so that the surface of the porcelain insulator 2 is cleaned of the carbon, it will cause sparks to be created between the first ground electrode 4 and the center electrode 3 again.

In order to minimize the wear of the center electrode 3 caused by the sparks produced within the second spark gaps, wear resisting members 7, as indicated by hatching in FIG. 2, are installed at least in portions of the side wall of the center electrode 3 which are opposed to the second ground electrodes 5 and 6 through the second spark gaps.

Figure 4A:
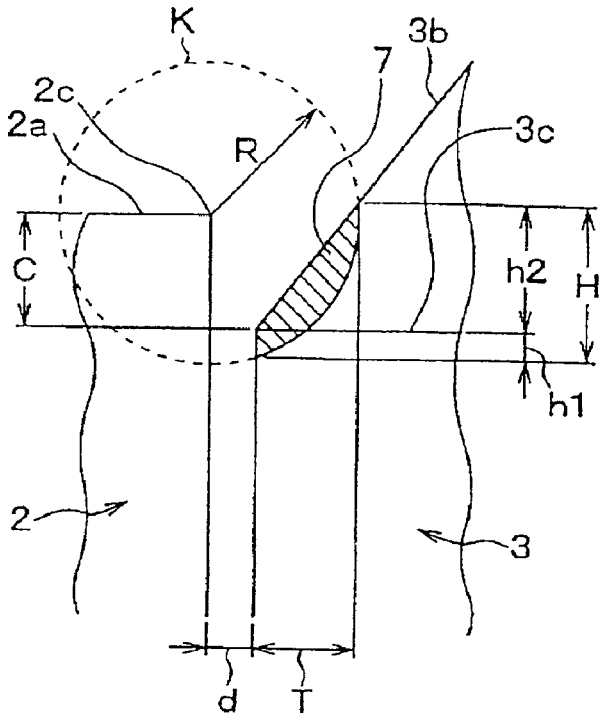
FIG. 4(*a*) is a partially longitudinal sectional view which shows a desired location of a wear resisting member installed on a center electrode.
Figure 4B:
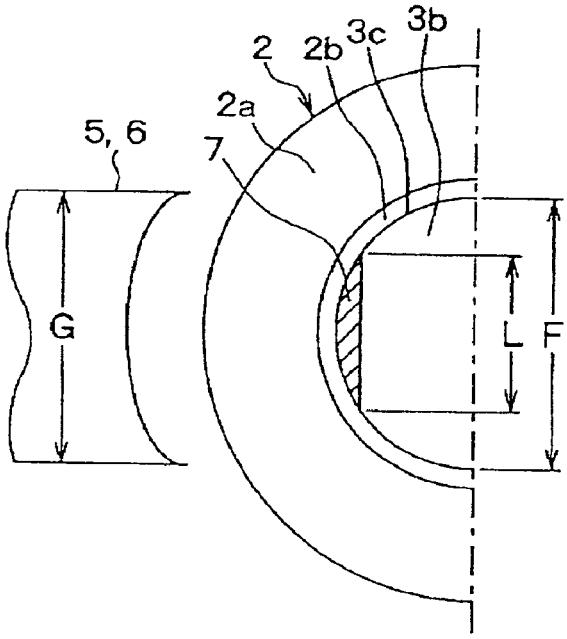

FIGS. 4(*a*) and 4(*b*) are enlarged views of FIGS. 2 and 3, respectively, which illustrate one of the wear resisting members 7. Note that FIG. 4(*a*) is reverse to FIG. 2 in a vertical direction, and the noble metal chip 3*d* is omitted for ease of visibility.

Each of the wear resisting members 7 is made of a metallic material which is higher in melting point than an Ni alloy that is material of the outside portion of the center electrode 3. For instance, each of the wear resisting members 7 may be made of a Pt alloy or an Ir alloy having a melting point of 1500° C. or more.

In FIG. 4(*a*), d indicates the interval between the inner surface of the tip 2*a* of the porcelain insulator 2 and the side surface of the center electrode 3. K indicates a circle which has the center defined on the inside comer 2*c* of the tip 2*a* of the porcelain insulator 2 and the radius R defined on a plane including a longitudinal center line of the spark plug 100. Each of the wear resisting members 7 is preferably located inside the circle K. The radius R is preferably greater than or equal to the interval d plus 0.1 mm (i.e., $R \geqq d+0.1$ mm).

Further, the width L, as shown in FIG. 4(*b*), of the wear resisting members 7 or the distance between sides of each of the wear resisting members 7 opposed in a widthwise direction of the second ground electrodes 5 and 6 is preferably greater than or equal to 0.5 mm. The wear resisting members 7 may alternatively be formed in the entire circumferential surface of the center electrode 3.

As an example, the interval C, as shown in FIG. 4(*a*), between the base 3*c* of the shoulder 3*b* of the center electrode 3 and the end of the tip 2*a* of the porcelain insulator 2 is 0.25 mm. The interval d is 0.05 mm. The diameter F, as shown in FIG. 4(*b*), of the large-diameter portion of the center electrode 3 is 2.3 mm. The width G of the second ground electrodes 5 and 6 is 2.2 mm. In this example, the radius R of the circle K is 0.05 mm. The distance H of the wear resisting members 7 in the lengthwise direction of the spark plug 100 is 0.3 mm. Of the distance H, the distance h1 between the base 3*c* of the shoulder 3*b* of the center electrode 3 and a lower end of the wear resisting members 7 leading to the large-diameter portion of the center electrode 3 is 0.05 mm. The distance h2 between the base 3*c* of the shoulder 3*b* and an upper end of the wear resisting members 7 lying on the shoulder 3*b* is 0.25 mm. The distance or depth T of the wear resisting members 7 in a radius direction of the spark plug 100 is 0.3 mm. The width L of the wear resisting members 7 is 1.0 mm.

Production process of the spark plug 100, especially formation of the wear resisting members 7 on the center electrode 3 will be described below in detail. Others are well known in the art, and explanation thereof in detail will be omitted here.

The wear resisting members 7 may be formed by either of a pair of Pt alloy bars, a pair of Pt alloy discs, and a single Pt alloy ring, as shown in FIGS. 5(*a*), 5(*b*), and 5(*c*), respectively. FIGS. 5(*a*) and 5(*b*) each show only one for the brevity of illustration. The Pt alloy bars each have a length m1 of 1.0 mm and a diameter m2 of 0.4 mm. The Pt alloy discs each have a diameter p1 of 1.0 mm and a thickness p2 of 0.4 mm. The Pt alloy ring has an outer diameter r1 of 2.4 mm and a sectional diameter r2 of 0.4 mm. In a case of the Pt alloy ring, the single wear resisting member 7 is, as apparent from the discussion below, provided around the periphery of the center electrode 3.

Fabrication processes of the Pt alloy bar of FIG. 5(*a*) are shown in FIGS. 6(*a*) to 6(*e*). Fabrication processes of the Pt alloy disc of FIG. 5(*b*) are shown in FIGS. 7(*a*) to 7(*e*). Fabrication processes of the Pt alloy ring of FIG. 5(*c*) are shown in FIGS. 8(*a*) to 8(*d*).

First, the fabrication processes of the Pt alloy bar of FIG. 5(*a*) will be described below.

The center electrode 3 is first machined to form, as shown in FIGS. 6(*a*) and 6(*b*), a small-diameter portion at an end thereof. The small-diameter portion is cut or ground to form opposed flat surfaces 10. For example, the interval n1 between the flat surfaces 10 is 2.0 mm. The length n2 of the small-diameter portion of the center electrode 3 is 1.2 mm.

Next, the two Pt alloy bars are, as shown in FIG. 6(*c*), placed on the flat surfaces 10 in parallel to each other in contact with the shoulder 15 and resistance-welded to the flat surfaces 10.

After the Pt alloy bars are welded, the end portion of the center electrode 3 is machined or ground, as shown in FIG. 6(*d*), to form the small-diameter portion 3*e*, the shoulder 3*b*, and the tip 3*a* and also finish the Pt alloy bars to a desired shape of the wear resisting members 7, as described above.

Finally, the noble metal chip 3*d* made of an Ir alloy or a Pt alloy is, as shown in FIG. 6(*e*), joined to the tip 3*a* of the center electrode 3 by laser-welding or resistance-welding. The center electrode 3 is inserted into the porcelain insulator 2 and secured in place using a glass material.

Next, the fabrication processes of the Pt alloy discs of FIG. 5(*b*) will be described below.

The center electrode 3 is, like the installation process of the Pt alloy bars, machined to form, as shown in FIGS. 7(*a*) and 7(*b*), a small-diameter portion at an end thereof. The small-diameter portion is cut or ground to form opposed flat surfaces 10. For example, the interval q1 between the flat surfaces 10 is 2.0 mm. The length q2 of the small-diameter portion of the center electrode 3 is 1.5 mm.

Next, the two Pt alloy discs are, as shown in FIG. 7(*c*), placed upright on the flat surfaces 10 in contact with the shoulder 15 so that major surfaces of the Pt alloy discs may be opposed in parallel to each other and resistance-welded to the flat surfaces 10.

After the Pt alloy discs are welded, the end portion of the center electrode 3 is machined or ground, as shown in FIG. 7(*d*), to form the small-diameter portion 3*e*, the shoulder 3*b*, and the tip 3*a* and also finish the Pt alloy discs to a desired shape of the wear resisting members 7, as described above.

Finally, the noble metal chip 3*d* made of an Ir alloy or a Pt alloy is, as shown in FIG. 7(*e*), joined to the tip 3*a* of the center electrode 3 by laser-welding or resistance-welding. The center electrode 3 is inserted into the porcelain insulator 2 and secured in place using a glass material.

The fabrication processes of the Pt alloy ring of FIG. 5(*c*) will be described below.

The center electrode 3 is, as shown in FIG. 8(*a*), machined to form a circular end with an annular shoulder 17 and the tip 3*a*.

Next, the Pt alloy ring is, as shown in FIG. 8(*c*), fitted on the annular shoulder 17. The noble metal chip 3*d* is placed on the tip 3*a* of the center electrode 3.

Finally, the Pt alloy ring and the noble metal chip 3*d* are, as shown in FIG. 8(*d*), laser-welded to the center electrode 3 to form the wear resisting member 7 around almost the entire periphery of the end of the center electrode 3. The wear resisting member 7 leads to the shoulder 3*b* (tapered surface in this case) of the center electrode 3. The Pt alloy ring may be configured so as to form the wear resisting member 7 around the entire periphery of the end of the center electrode 3. In this example, the base 3*c* of the tapered surface 3*b* lies flush with the surface of the wear resisting member 7. After the process of FIG. 8(*d*), the end of the center electrode 3 and the wear resisting member 7 may be machined or ground to a desired shape. Finally, the center electrode 3 is inserted into the porcelain insulator 2 and secured in place using a glass material.

The use of the Pt alloy ring permits the wear resisting member 7 to be formed around the entire periphery of the end of the center electrode 3 so that the second ground electrodes 5 and 6 may face the wear resisting member 7 necessarily, thus eliminating the need for positioning the center electrode 3 relative to the porcelain insulator 2 when the center electrode 3 is secured to the porcelain insulator 2.

The noble metal chip 3*d* installed on the tip 3*a* of the center electrode 3 in order to improve the wear resistance thereof may be omitted.

As already discussed, each of the wear resisting members 7 is located inside the circle K, as shown in FIG. 4(*a*), which has the radius R preferably greater than or equal to the interval d plus 0.1 mm (i.e., $R \geqq d+0.1$ mm). Researches carried out by the inventor of this application showed that the installation of the wear resisting members 7 inside the circle K ensures a desired degree of resistance to the wear of the side surface of the center electrode 3 over a travel distance of 100000 to 20000 km in an automotive vehicle on which a gasoline engine is mounted.

The width L, as shown in FIG. 4(*b*), of the wear resisting members 7 is, as described above, preferably greater than or equal to 0.5 mm. This alleviates the problem that sparks produced between the side surface of the center electrode 3 and the second ground electrodes 5 and 6 cause portions of the side surface of the center electrode 3 around the wear resisting members 4 to be worn greatly and scooped away in a case where the width L is less than 0.5 mm, so that sparks hardly fly to the scooped portions, thereby resulting in concentration of sparks on the wear resisting members 7 which may cause the porcelain insulator 2 to be removed partly, thereby forming an unwanted groove(s).

FIGS. 9(*a*) and 9(*b*) show examples where the single wear resisting member 7 is formed around the entire periphery of the end of the center electrode 3. In either case, the wear resisting member 7 face the second ground electrodes 5 and 6. Specifically, the wear resisting member is formed at least in a portion of the side wall of the center electrode 3 which defines a second spark gap within which sparks are initiated when carbon is deposited on the tip of the porcelain insulator 2.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug comprising:

a metal housing;

a porcelain insulator installed in said metal housing;

a center electrode retained within said porcelain insulator, said center electrode having a length and a tip portion projecting from a tip of said porcelain insulator;

a shoulder formed on a side wall of said center electrode to define a large-diameter portion and a small-diameter portion of said center electrode, said shoulder tapering off to the tip portion of said center electrode and having a boundary leading to the large-diameter portion located inside said porcelain insulator;

a first ground electrode being installed on said metal housing which has an end portion opposed to the tip portion of said center electrode to define a first spark gap between;

a noble metal chip being disposed on the tip portion of the center electrode which faces the first ground electrode;

a second ground electrode installed on said metal housing which has an end arranged outside the tip of said porcelain insulator and opposed over the tip of said porcelain insulator to a portion of the side wall of said center electrode to define a second spark gap in which sparks are to be generated to burn away carbon adhered to a surface of the tip of said porcelain insulator, resulting in a decrease in insulation resistance offered by said porcelain insulator; and a wear resisting member provided on said portion of the side wall of said center electrode for offering resistance to wear caused by the sparks generated in the second spark gap, said wear resisting member being different from said noble metal chip disposed on the tip portion of the center electrodes, wherein an interval between an inner wall of said porcelain insulator and the side wall of said center electrode is defined as d, and a circle is defined which has a center on an inside corner of the tip of said porcelain insulator facing said center electrode and a radius R defined on a plane including a longitudinal center line of the spark plug, the radius R is the interval d plus 0.1 mm, and said wear resisting member is located at least inside the circle.

2. A spark plug as in claim 1, wherein said wear resisting member has a width which is opposed to said second ground electrode and greater than or equal to 0.5 mm.

3. A spark plug as in claim 2, wherein said wear resisting member is provided over an entire circumference of a portion of the side wall of said center electrode.

4. A spark plug as in claim 1, wherein said wear resisting member has a surface substantially lying flush with a surface of the side wall of said center electrode.

5. A spark plug as in claim 1, wherein said wear resisting member is made of a metallic material which is higher in melting point than an Ni alloy.

6. A spark plug as in claim 5, wherein said metallic material is one of the group consisting of a Pt alloy and an Ir alloy.

7. A spark plug comprising:

a first spark gap defined between an end of a center electrode and a first ground electrode disposed in opposition to said end along a longitudinal axis of said center electrode;

a second spark gap defined radially along a side wall portion of said center electrode and a second ground electrode disposed in opposition to said side wall portion radially outwardly of said center electrode;

an insulator circumferentially encompassing a portion of the center electrode and having an end portion of said insulator extending partially into said second spark gap; and a wear resisting material disposed on said side wall portion of said center electrode at said second spark gaps, wherein an interval between an inner wall of said insulator and the side wall portion of said center electrode is defined as d, and a circle is defined which has a center on an inside corner of the tip of said insulator facing said center electrode and a radius R defined on a plane including a longitudinal center line of the spark plug, the radius R is the interval d plus 0.1 mm, and said wear resisting material is located at least inside the circle.

8. A spark plug as in claim 7 wherein said wear resisting material has a width which is opposed to said second ground electrode and greater than or equal to 0.5 mm.

9. A spark plug as in claim 8 wherein said wear resisting member is provided over an entire circumference of a portion of the side wall of said center electrode.

10. A spark plug as in claim 7 wherein said wear resisting material has a surface substantially lying flush with a surface of the side wall of said center electrode.

11. A spark plug as in claim 7 wherein said wear resisting material is made of a metallic material which is higher in melting point than an Ni alloy.

12. A spark plug as in claim 11 wherein said metallic material is one of the group consisting of a Pt alloy and an Ir alloy.

* * * * *